US007481699B2

(12) United States Patent
Schweitzer

(10) Patent No.: US 7,481,699 B2
(45) Date of Patent: Jan. 27, 2009

(54) FAN-TYPE GRINDING WHEEL

(75) Inventor: Olaf Schweitzer, Gummersbach (DE)

(73) Assignee: August Ruggeberg GmbH & Co. KG, Marienheide (DE)

( * ) Notice: Subject to any disclaimer, the term of this patent is extended or adjusted under 35 U.S.C. 154(b) by 3 days.

(21) Appl. No.: 11/752,632

(22) Filed: May 23, 2007

(65) Prior Publication Data

US 2007/0275643 A1 Nov. 29, 2007

(30) Foreign Application Priority Data

May 23, 2006 (DE) ..... 10 2006 024 015
Dec. 28, 2006 (EP) ..... 06026974

(51) Int. Cl.
*B24D 13/04* (2006.01)

(52) U.S. Cl. ..... 451/466; 451/465

(58) Field of Classification Search ..... 15/230; 451/465–478

See application file for complete search history.

(56) References Cited

U.S. PATENT DOCUMENTS 1,869,564 A * 8/1932 Johnston ..... 15/230
2,907,147 A * 10/1959 Hall et al. ..... 451/527
4,679,360 A * 7/1987 Eisenblatter ..... 451/469
6,955,591 B2 * 10/2005 Deware ..... 451/470

FOREIGN PATENT DOCUMENTS

DE 20018756 U1 11/2000
EP 1142673 B1 7/2005

* cited by examiner

*Primary Examiner*—Timothy V Eley
(74) *Attorney, Agent, or Firm*—Browdy and Neimark, P.L.L.C.

(57) ABSTRACT

A fan-type grinding wheel which can be driven in rotation in a direction of rotation comprises, on an annular rim region of a support plate, grinding blades which are configured in the form of a triangle. The outer edge of each grinding blade defines a portion of an outer rim of a grinding blade package. The inner edge extends from an inner rim of the grinding blade package to the outer rim. The rear edge is exposed and extends in a leading manner from the inner rim to the outer rim of the grinding blade package—with respect to a direction of rotation.

18 Claims, 6 Drawing Sheets

FAN-TYPE GRINDING WHEEL

BACKGROUND OF THE INVENTION

1. Field of the Invention

The invention relates to a fan-type grinding wheel which is drivable in a direction of rotation, with a support plate which comprises a centre line, an inner hub an annular rim region, and with grinding blades which are fastened on the rim region so as to form an annular grinding blade package.

2. Background Art

A fan-type grinding wheel of this type is known from EP 1 142 673 B1. With this known fan-type grinding wheel, the grinding blades have a rectangular configuration. They have two mutually parallel straight edges and a concave edge and a convex edge. The convex edge and the concave edge are each configured in the form of an arc of which the radii are equal, but where the centres of the radii are offset from one another on a line parallel to the straight edges. The advantage of this configuration of the grinding blades is that they can be cut, with out scrap, in other words without waste from a grinding belt with mutually parallel edges. The grinding blades are fastened in a mutually overlapping manner on the rim region of the support plate, a portion of the outer rim of the grinding blade package being formed by the convex edge of each grinding blade.

SUMMARY OF THE INVENTION

The object of the invention is to configure a fan-type grinding wheel of the type mentioned at the outset in such a way that its tool life is further increased.

According to the invention, this object is achieved by a fan-type grinding wheel which is drivable in rotation in a direction of rotation, with a support plate which comprises a centre line, an inner hub and an annular rim region, with grinding blades which are configured in the basic shape of a triangle with three main edges, namely an outer edge, an inner edge, and a rear edge and are arranged at equal angular intervals on the rim region so as to form an annular grinding blade package in such a way that the outer edge (defines a portion of an outer rim of the grinding blade package, the inner edge extends from an inner rim of the grinding blade package to the outer rim and is covered in part by grinding blades, which precede it in the direction of rotation, and the rear edge is exposed and extends in a leading manner from the inner rim to the outer rim of the grinding blade package—with respect to the direction of rotation. As a result of the configuration according to the invention, a particularly large amount of grinding blade material is concentrated in the radially outer region of the grinding blade package, so a particularly high service life is achieved simultaneously with high aggressiveness, in other words a high intensity of grinding. The scrap produced during cutting of the grinding blades is taken into consideration because overall—considered over the service life of the fan-type grinding wheel—little grinding belt material, in other words few grinding blades, are used up for a grinding task. In particular, owing to the configuration according to the invention, the grinding blades located on the support plate can also be used up almost completely, so there is only a little waste to dispose of.

As the result of the advantageous development of a fan-type grinding wheel wherein the outer edge has a convexly curved configuration with a radius of curvature R2 or R2*a* and, in particular, a fan-type grinding wheel wherein the outer rim of the grinding blade package has an outer radius R13 which is equal to the radius of curvature R2 or R2*a* of the curved outer edge, the outer rim of the grinding blade package is defined in the form of a clean circle by the grinding blades. The outer radius of the grinding blade package and the radius of the curved outer edge obviously do not have to be absolutely identical but only substantially identical. A configuration of the rear edge having a rectilinear configuration is basically possible and affords advantages during the cutting of the grinding blade, as a rectilinear cut is basically easier to achieve than a curved cut, in any case when punching tools or cutting blades are used for cutting. However, a convexly curved configuration with a radius of curvature R4 or R4*a* is more advantageous for use in grinding.

As a result of the development of a fan-type grinding wheel wherein a tangent to the rear edge at an intersection point between the outer edge and the rear edge and a radius R13 from the centre line through the intersection point enclose an angle $\alpha$ which is open relative to the radius R13 in the direction of rotation, in particular, the grinding region, located in the region of the rear edge, of each grinding blade has an optimum shape from the outset, this being particularly the case in the combination with a convexly curved configuration with a radius of curvature R4 or R4*a*. The term at an open angle relative to the radius' means that the angle leads relative to the radius in the direction of rotation.

A fan-type grinding wheel wherein the inner edge is concavely curved with a radius of curvature R3 or R3*a* and a fan-type grinding wheel wherein the inner edge has a rectilinear configuration provide advantageous configurations of the inner edge, the inner edge being concavely curved with a radius of curvature R3 or R3*a* having the advantage that the grinding blades can be cut compactly from a grinding belt. The inner edge having a rectilinear configuration is particularly preferred if the grinding blades are not cut out of strips from a roll but from sheets in a staple where they can fit into each other.

A fan-type grinding wheel wherein $10 \leqq n \leqq 80$ applies to the number n of grinding blades arranged on a support plate and wherein each grinding blade extends over an angle $\beta$ of the circular grinding blade package to which $25° \leqq \beta \leqq 90°$ applies and wherein $5° \leqq \alpha \leqq 35°$ applies to the angle $\alpha$ provide further advantageous configurations.

According to a fan-type grinding wheel wherein at least two main edges intersect at an intersection point and wherein all main edges intersect at an intersection point, the grinding blades have a true triangular shape, in other words two main edges each intersect at an intersection point regardless of whether they are rectilinear or curved. On the other hand, a fan-type grinding wheel wherein at least two main edges are joined together by a convexly curved secondary edge and a fan-type grinding wheel wherein all main edges are joined together by convexly curved secondary edges relate to a particularly preferred embodiment in which the corners of the respective triangle are rounded, more specifically by convexly curved secondary edges of which the radii of curvature are much smaller than the radii of curvature of the main edges. The advantage of this configuration is that both the production of the punching tools and the release of the grinding blades after punching from the belt material are simplified. The production of true acute angles with the punching tools is more complex. The release of a grinding blade, which is triangular in the true sense, from the belt material is more difficult than the release of a grinding blade with rounded corners. A fan-type grinding wheel wherein at least two main edges intersect at an intersection point on the one hand and a fan-type grinding wheel wherein at least two main edges are joined together by a convexly curved secondary edge on the other hand also include mixed shapes between these two configurations.

Further advantages, features and details of the invention will emerge from the following description of embodiments given with reference to the drawings.

DESCRIPTION OF THE PREFFERED EMBODIMENTS

Figure 1:
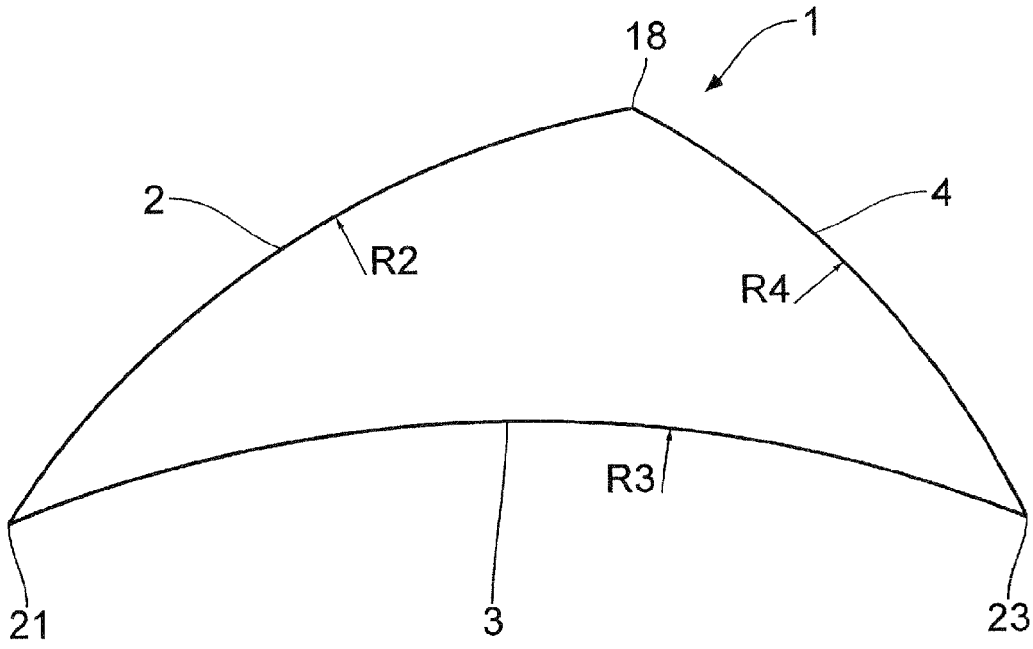
FIG. 1 shows a plan view of a grinding blade.

The grinding blade 1 shown in FIG. 1 has a triangular configuration. Its three edges are called outer edge 2, inner edge 3 and rear edge 4, depending on their subsequent position on a support plate of a fan-type grinding wheel. The edges 2 to 4 are configured as arcuate portions with a corresponding radius of curvature R2, R3 and R4. With respect to the grinding blade 1, the outer edge 2 and the rear edge 4 have a convex configuration while the inner edge 3 has a concave configuration. Geometric shapes of this type are also triangles as, according to the rules of spherical geometry, the boundary lines of a triangle do not have to be rectilinear, but can also be curved. It is crucial that two respective lateral edges intersect at a point of intersection, in other words form a corner.

Figure 2:
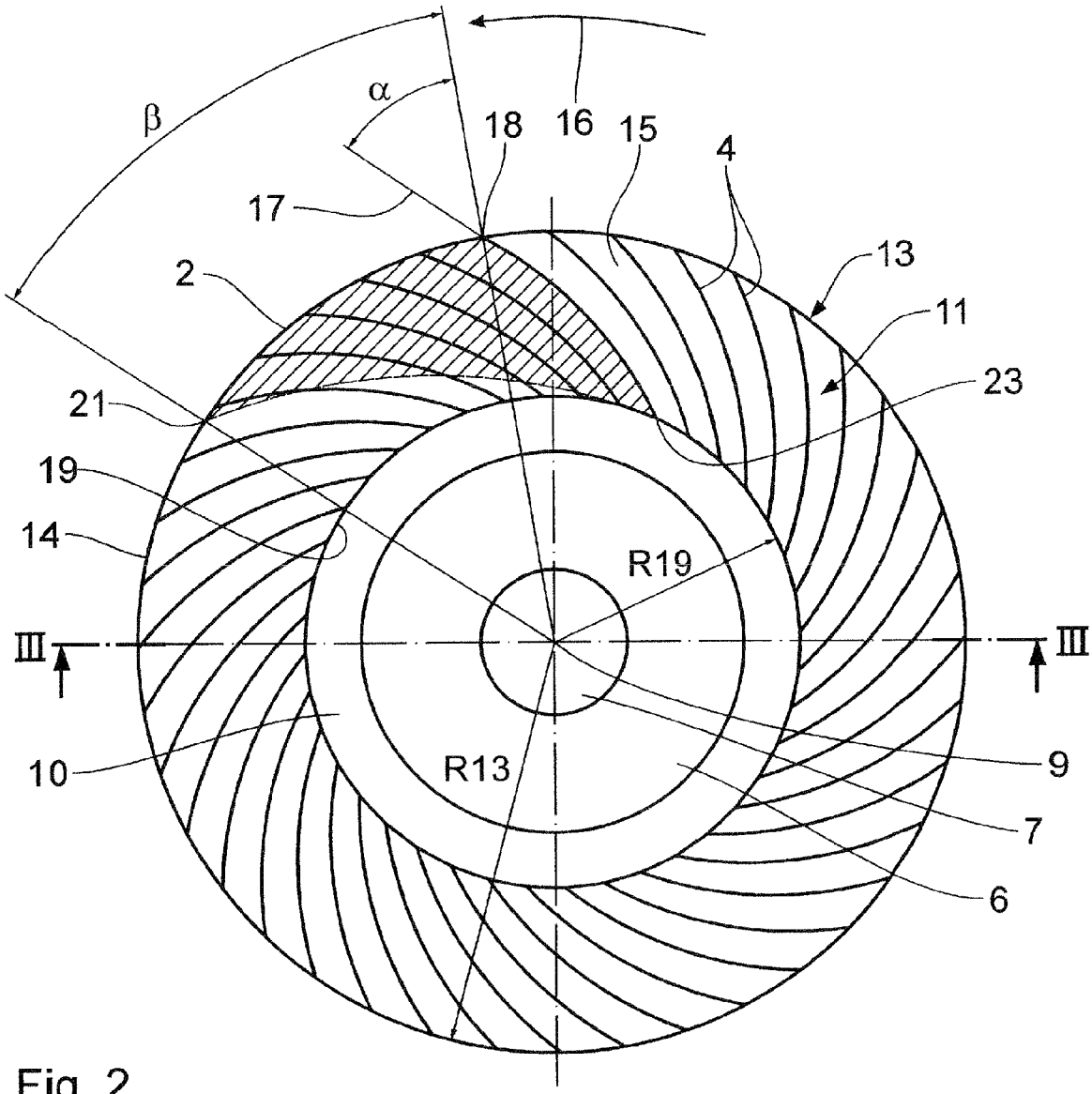
FIG. 2 shows a plan view of a fan-type grinding wheel according to the invention.
Figure 3:
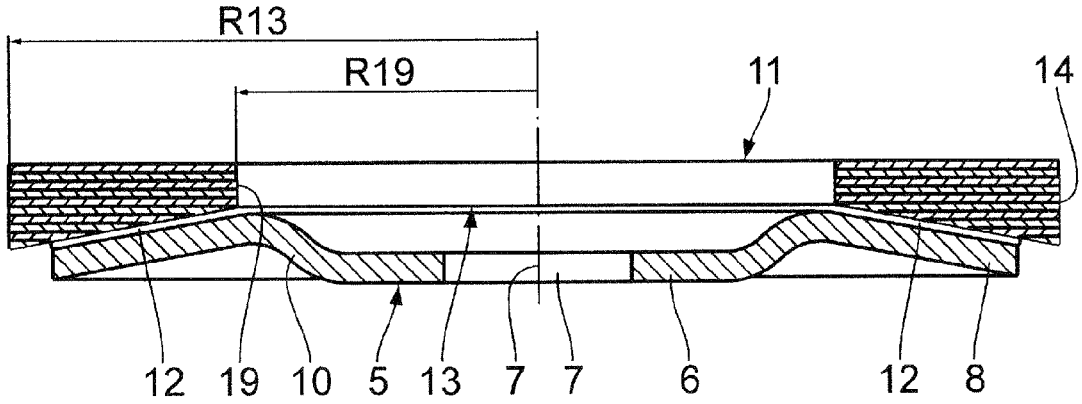
FIG. 3 shows a cross section through the fan-type grinding wheel according to FIG. 2.

Referring to FIGS. 2 and 3, a fan-type grinding wheel comprises a support plate 5 with a hub 6 comprising a central circular opening 7. The support plate 5 has an outer annular rim region 8 for receiving the grinding blades 1. This rim region 8 is connected to the hub 6 via an annular web 10 which projects in the direction of the centre line 9 of the support plate 5. The rim region 8 is inclined radially outwardly from the annular web 10, as shown in FIG. 3. As a result, the working face 11 of the grinding blades 1 which are to be arranged on the support plate 5 in turn extends substantially radially and perpendicularly to the centre line 9. This geometry is due to the fact that more and more grinding blades 1 overlap or cover one another from the interior outwards, as shown in FIG. 2. The grinding blades 1 are fastened on the rim region 8 of the support plate 5 using an adhesive layer 12.

Referring in particular to FIG. 2, the grinding blades 1 are arranged at equal angular intervals on the support plate 5, more specifically rotationally symmetrically in each case in the same position relative to the support plate 5. In the embodiment shown in FIGS. 2 and 3, the outer radius R13 of the grinding blade package 13 fastened on the support plate 5 corresponds to the radius of curvature R2 of the outer edge 2, so that the outer rim 14 projecting outwardly beyond the rim region 8, of the grinding blade package 13 is circular.

A grinding blade 1 is shown in broken lines in FIG. 2, although its respective grinding region 15 extends only from its rear edge 4 to the next rear edge 4 arranged in a leading manner in the direction of rotation 16 of the grinding wheel.

Referring again to FIG. 2, the tangent 17 to the rear edge 4 at the point of intersection 18 with the outer edge 2 and the radius R13 through the point of intersection 18 form an angle $\alpha>0$, the tangent 17 leading relative to the radius R13 in the direction of rotation $16.5° \leqq \alpha \leqq 35°$ applies to this angle $\alpha$.

In this embodiment, R2≅R4 and R3>R2 and R3>R4. Since the inner edge 3—with respect to the grinding blade 1—extends concavely, the number of overlaps of adjacent grinding blades 1 is much smaller in the region of the inner rim 19 of the grinding blade package 13 than in the outer region and increases significantly only towards the exterior, as shown by the hatched area in FIG. 2.

Referring again to FIG. 2, the outer edge 2 of each grinding blade 1 extends over an angle $\beta$ of the circular grinding blade package 13, wherein $25° \leqq \beta \leqq 90°$ applies. $10 \leqq n \leqq 80$ applies to the number n of grinding blades 1.

Figure 4:
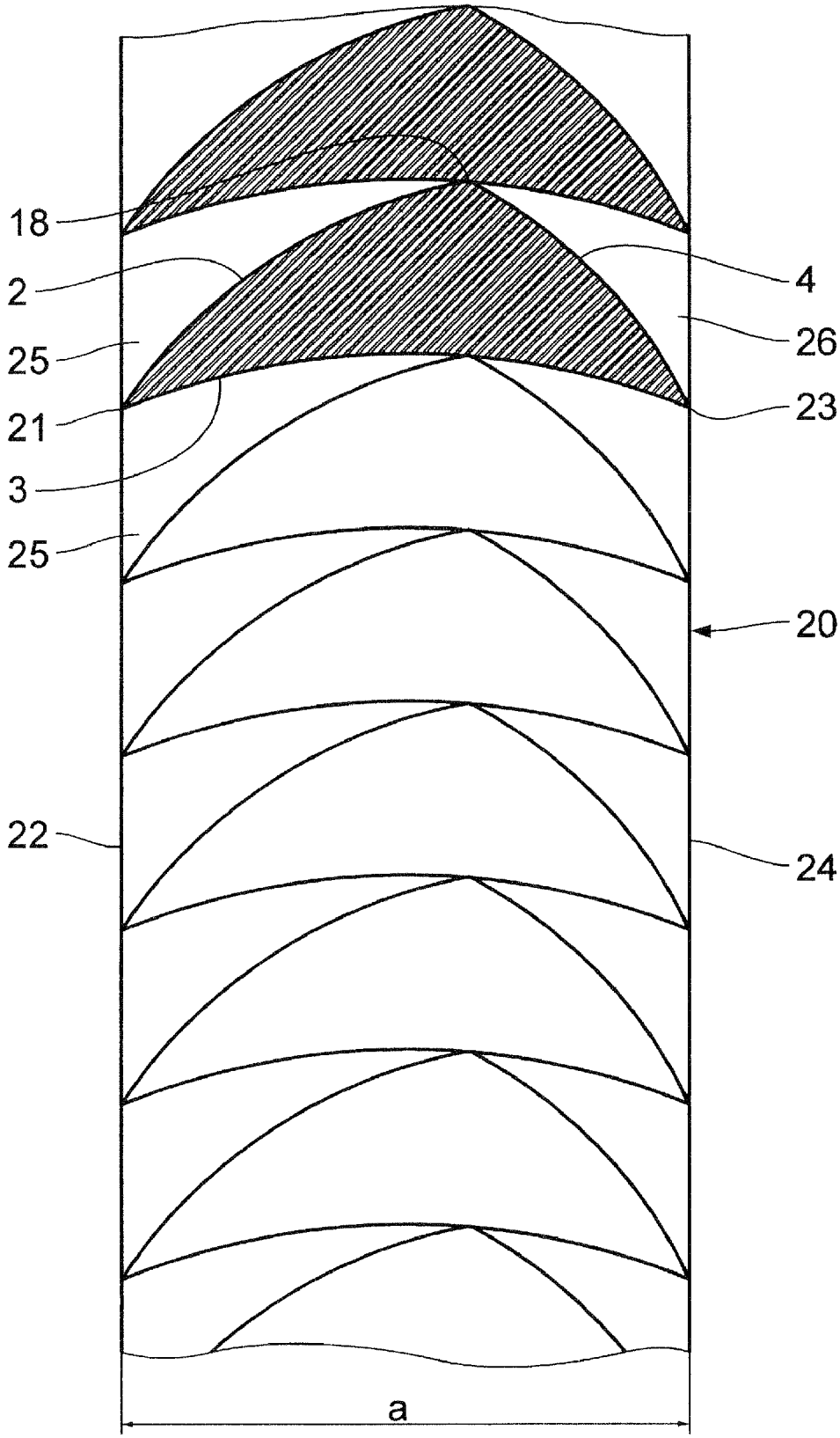
FIG. 4 shows a grinding belt from which grinding blades are to be cut in succession.

FIG. 4 shows how the grinding blades 1 are cut from a grinding belt 20. The width a of the grinding belt 20 is selected in such a way that the intersection point 21 of the outer edge 2 and the inner edge 3 lies on a longitudinal rim 22 of the grinding belt 20 whereas the intersection point 23 between the inner edge 3 and the outer edge 4 lies on the other longitudinal rim 24 parallel to the longitudinal rim 22. The intersection point 18 between the outer edge 2 and the rear edge 4 abuts the inner edge 3 of the grinding blade 1 which is to be cut out adjacently. This method of cutting the grinding blades 1 results in scrap cut portions 25, 26. This scrap is not detrimental as the arrangement—trailing from the exterior inwardly with respect to the direction of rotation 16—of the rear edge 4 on the support plate 5 leads to optimum, i.e. minimum wear of the grinding blades 1 from the beginning of grinding with a new fan-type grinding wheel. The concave configuration of the inner edge 3 also reduces scrap.

Figure 7:
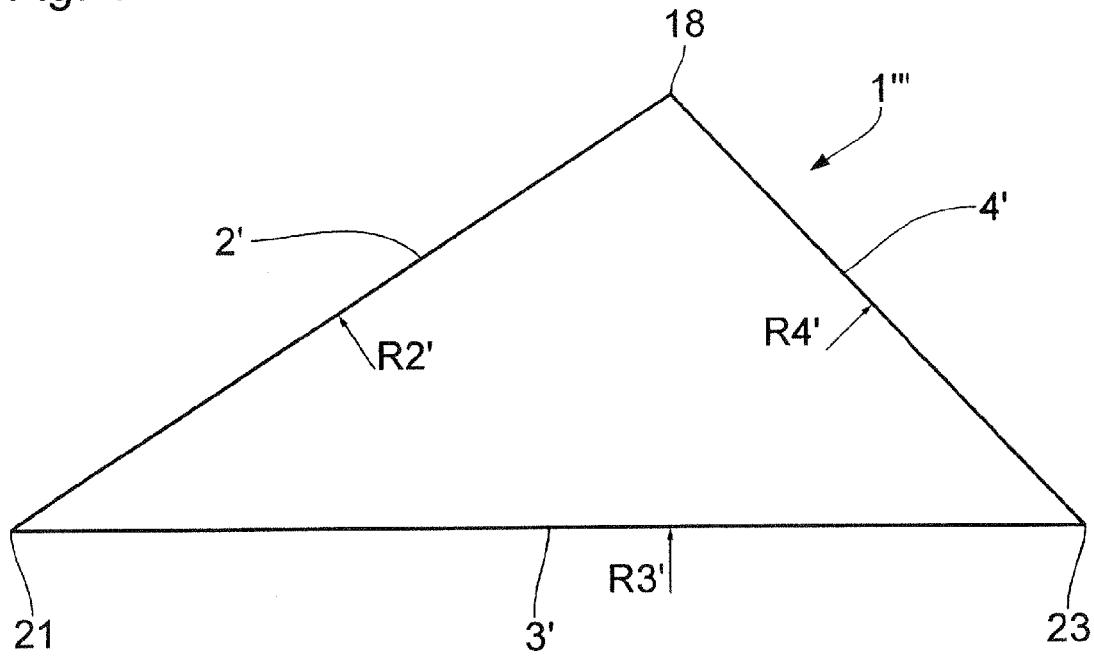
FIG. 7 shows a further modified embodiment of a grinding blade.
Figure 5:
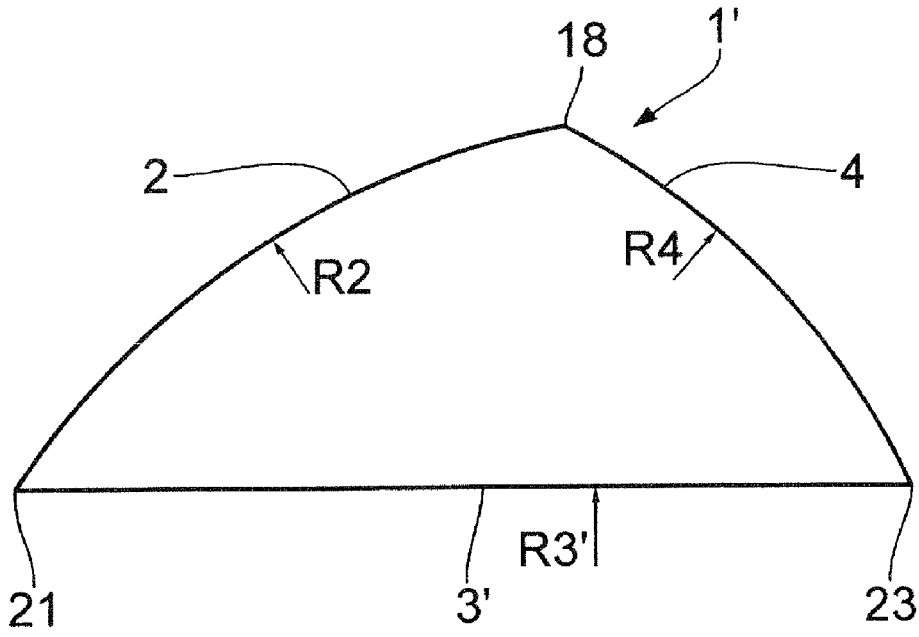
FIG. 5 shows a modified embodiment of a grinding blade.
Figure 6:
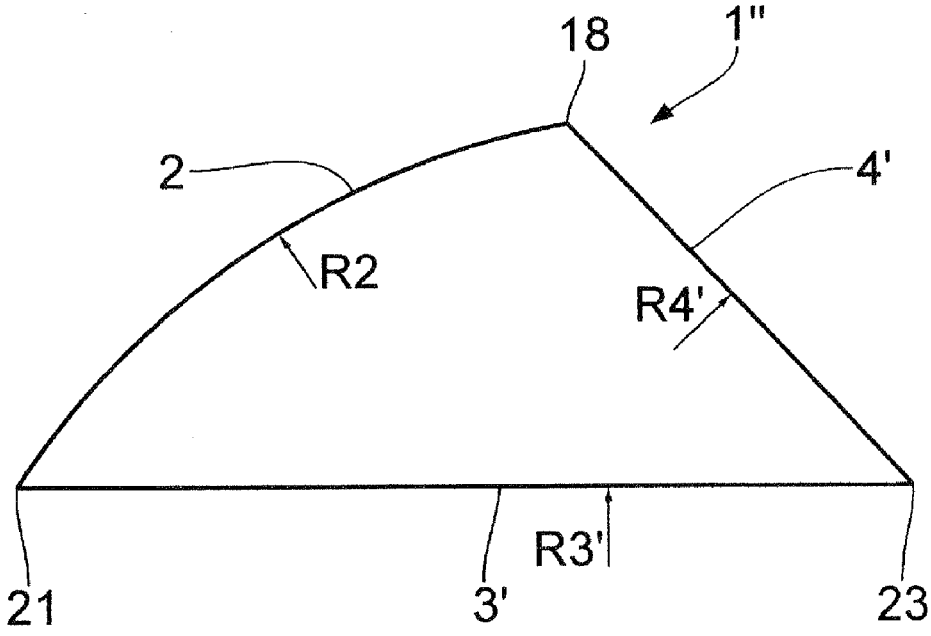
FIG. 6 shows a further modified embodiment of a grinding blade.

FIGS. 5 to 7 show variations of the grinding blades. The grinding blade 1' shown in FIG. 5 has the aforementioned outer edge 2 and rear edge 4. However, the inner edge 3' has a rectilinear configuration. Its radius of curvature R3' is therefore infinitely long.

Referring to FIG. 6, the grinding blade 1" shown therein has an arcuate outer edge 2, as already described, and a rectilinear inner edge 3', also as already described. The rear edge 4' also has a rectilinear configuration, the foregoing statement concerning the angle $\alpha$ also applying to the rear edge 4' on the support plate 5. The radius of curvature R4' therefore has an infinite length.

Finally, FIG. 7 also shows the configuration of a grinding blade 1''', with which not only the inner edge 3' and the rear edge 4' but also the outer edge 2' have a rectilinear configuration. The radius of curvature R2' therefore also has an infinite length.

The embodiments according to FIGS. 8 to 11 correspond in their basic construction to the embodiments according to FIGS. 1, 5, 6 and 7, rounded corners being provided instead of the sharp-edged points of intersection 18, 21, 23 respectively. Each of these grinding blades therefore have the basic shape of a triangle. The outer edges, inner edges and rear edges forming main edges are therefore connected to one another by convexly curved secondary edges, the radius of curvature r of which is much smaller in each case than the radius of curvature R of the aforementioned main edges. The outer edges, inner edges and rear edges forming the main edges are designated with the same reference numerals in FIGS. 8 to 11 as the corresponding edges in FIGS. 1, 5, 6 and 7, with the addition of a distinguishing "a" in each case. The same applies to the radii of curvature R.

The secondary edges are provided with the same reference numerals as the intersection points 18, 21, 23, also with the addition of a distinguishing "a". The same applies to the designation of the radii of curvature r of the secondary edges.

Figure 8:
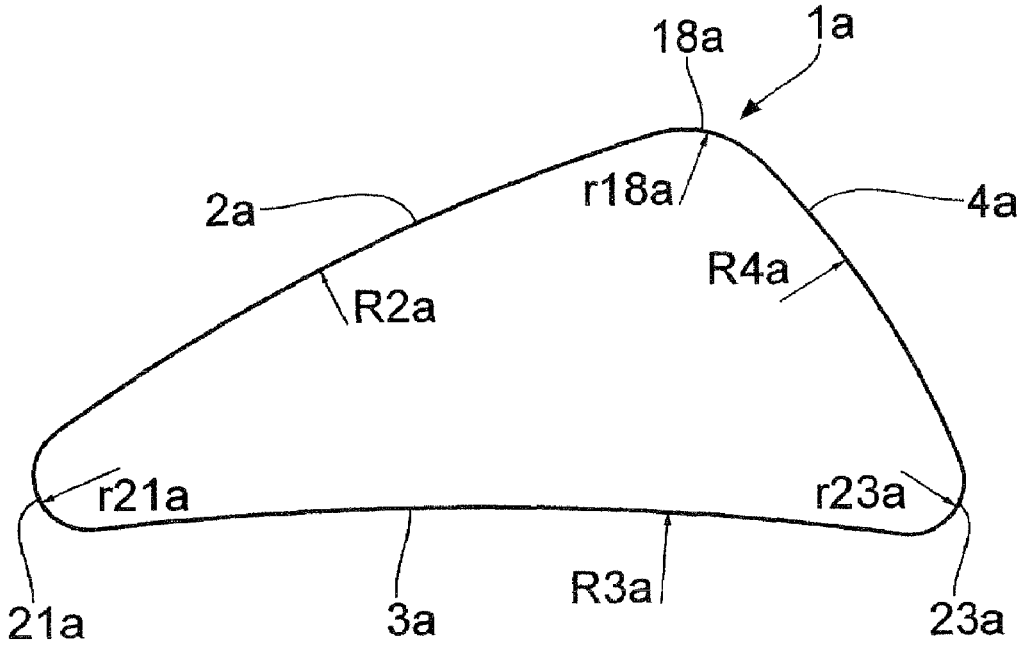
FIG. 8 shows a grinding blade similar to the illustration in FIG. 1 with rounded corners.

The following applies, in particular:

With the grinding blade 1*a* according to FIG. 8, all three main edges, namely the outer edge 2*a*, the inner edge 3*a* and the rear edge 4*a* have a curved configuration, more specifically, the outer edge 2*a* and the rear edge 4*a* are convexly curved whereas the inner edge 3*a* is concavely curved. The radii of curvature are R2*a*, R4*a* and R3*a*. The main edges are each connected to one another by three secondary edges R18*a*, R21*a* and R23*a* which are convexly curved and have radii of curvature r18*a*, r21*a* and r23*a*.

Figure 9:
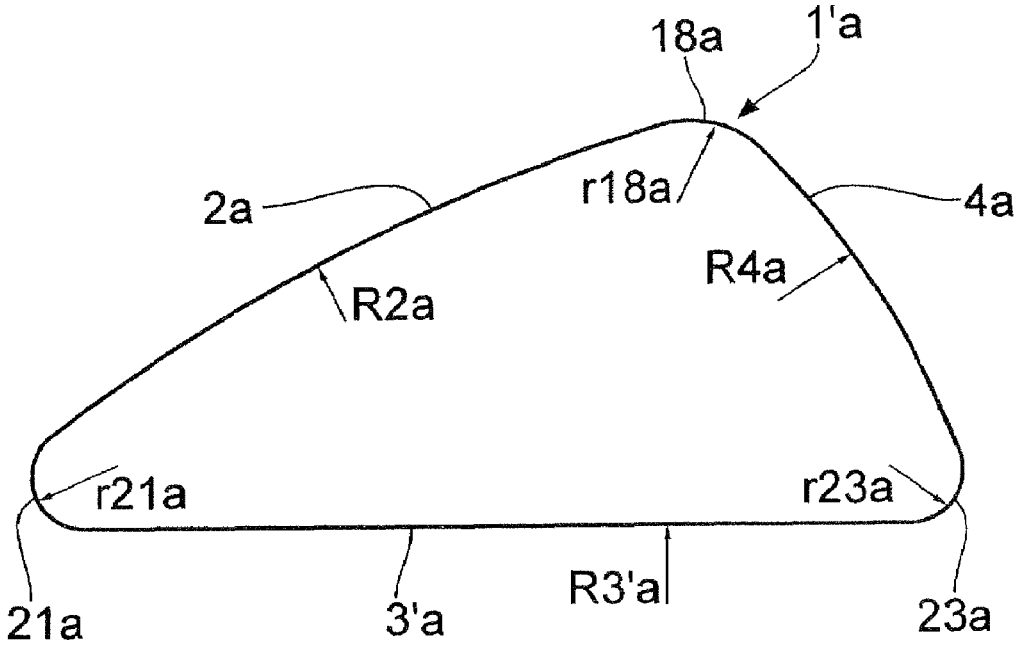
FIG. 9 shows a grinding blade similar to the illustration in FIG. 5 with rounded corners.

The grinding blade 1'*a* according to FIG. 9 differs from that according to FIG. 8 in that the inner edge 3'*a* has a rectilinear configuration and the radius of curvature R3'*a* of this inner edge 3'*a* consequently has an infinite length.

Figure 10:
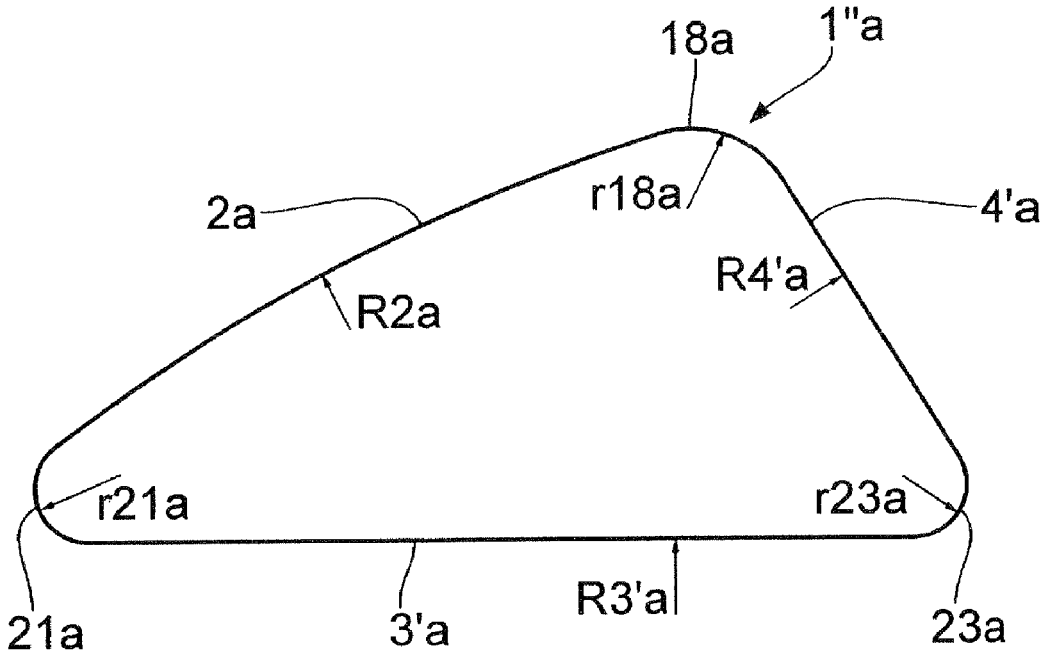
FIG. 10 shows a grinding blade similar to the illustration in FIG. 6 with rounded corners.

The grinding blade 1"*a* according to FIG. 10 in turn differs from that according to FIG. 9 in that the rear edge 4'*a* also has a rectilinear configuration and its radius of curvature R4*a* consequently has an infinite length.

Figure 11:
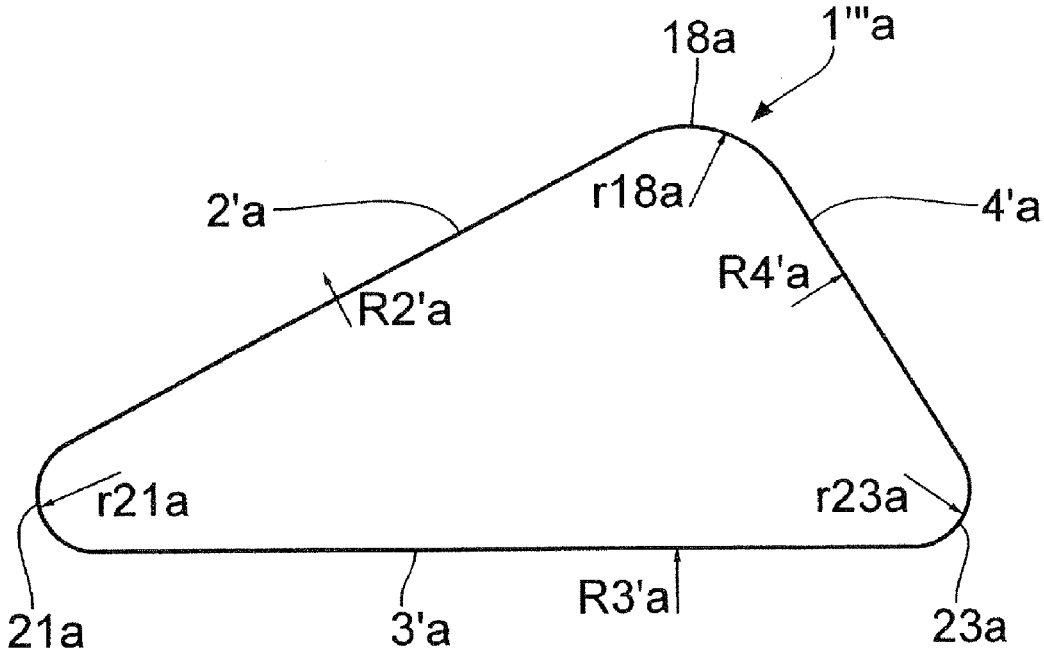
FIG. 11 shows a grinding blade similar to the illustration in FIG. 7 with rounded corners.

With the grinding blade 1''' according to FIG. 11, finally all three main edges have a rectilinear configuration, in other words also the outer edge 2'*a*, of which the radius of curvature R2'*a* consequently has an infinite length.

The radii of curvature R of the main edges are much greater than the radii of curvature r of the secondary edges. $3 \leqq R/r$ and preferably $10 \leqq R/r$ apply. If the main edges do not have a rectilinear construction, $3 \leqq R/r \leqq 20$ and preferably $10 \leqq R/r \leqq 20$ applies to the ratio of the radii of curvature R of the main edges to the radii of curvature r of the secondary edges.

What is claimed is:

1. A fan-type grinding wheel which is drivable in rotation in a direction of rotation (16), with a support plate (5) which comprises a centre line (9), an inner hub (6) and an annular rim region (8), with grinding blades (1, 1', 1", 1''', 1*a*, 1'*a*, 1"*a*, 1'''*a*) which are each configured in the basic shape of a triangle with three main edges, namely an outer edge (2, 2', 2*a*, 2'*a*), an inner edge, (3, 3', 3*a*, 3'*a*) and a rear edge (4, 4', 4*a*, 4'*a*) and are each arranged at equal angular intervals on the rim region (8) so as to form an annular grinding blade package (13) in such a way that the outer edge (2, 2', 2*a*, 2'*a*) defines a portion of an outer rim (14) of the grinding blade package (13), the inner edge (3, 3', 3*a*, 3'*a*) extends from an inner rim (19) of the grinding blade package (13) to the outer rim (14) and is covered in part by grinding blades (1, 1', 1", 1''', 1*a*, 1'*a*, 1"*a*, 1'''*a*), which precede it in the direction of rotation (16), and the rear edge (4, 4', 4*a*, 4'*a*) is exposed and extends in a leading manner from the inner rim (19) to the outer rim (14) of the grinding blade package (13)—with respect to the direction of rotation (16).

2. A fan-type grinding wheel according to claim 1, wherein the outer edge (2, 2*a*) has a convexly curved configuration with a radius of curvature R2 or R2*a*.

3. A fan-type grinding wheel according to claim 2, wherein the outer rim (14) of the grinding blade package (13) has an outer radius R13 which is equal to the radius of curvature R2 or R2*a* of the curved outer edge (2).

4. A fan-type grinding wheel according to claim 1, wherein the rear edge (4', 4'*a*) has a rectilinear configuration.

5. A fan-type grinding wheel according to claim 4, wherein a tangent (17) to the rear edge (4, 4') at an intersection point (18) between the outer edge (2, 2') and the rear edge (4' 4') and a radius R13 from the centre line (9) through the intersection point (18) enclose an angle $\alpha$ which is open relative to the radius R13 in the direction of rotation (16).

6. A fan-type grinding wheel according to claim 5, wherein $5° \leqq \alpha \leqq 35°$ applies to the angle $\alpha$.

7. A fan-type grinding wheel according to claim 1, wherein the rear edge (4, 4*a*) has a convexly curved configuration with a radius of curvature R4 or R4*a*.

8. A fan-type grinding wheel according to claim 7, wherein a tangent (17) to the rear edge (4, 4') at an intersection point (18) between the outer edge (2, 2') and the rear edge (4' 4') and a radius R13 from the centre line (9) through the intersection point (18) enclose an angle $\alpha$ which is open relative to the radius R13 in the direction of rotation (16).

9. A fan-type grinding wheel according to claim 1, wherein the inner edge (3, 3*a*) is concavely curved with a radius of curvature R3 or R3*a*.

10. A fan-type grinding wheel according to claim 1, wherein the inner edge (3', 3'*a*) has a rectilinear configuration.

11. A fan-type grinding wheel according to claim 1, wherein $10 \leqq n \leqq 80$ applies to the number n of grinding blades (1, 1', 1", 1''') arranged on a support plate (5).

12. A fan-type grinding wheel according to claim 1, wherein each grinding blade (1, 1', 1", 1''') extends over an angle $\beta$ of the annular grinding blade package (13) to which $25° \leqq \beta \leqq 90°$ applies.

13. A fan-type grinding wheel according to claim 1, wherein at least two main edges intersect at an intersection point (18, 21, 23).

14. A fan-type grinding wheel according to claim 13, wherein all main edges intersect at an intersection point (18, 21, 23).

15. A fan-type grinding wheel according to claim 1, wherein at least two main edges are joined together by a convexly curved secondary edge (18*a*, 21*a*, 23*a*).

16. A fan-type grinding wheel according to claim 15, wherein the three main edges are joined together by convexly curved secondary edges (18*a*, 21*a*, 23*a*).

17. A fan-type grinding wheel according to claim 1, wherein at least two main edges are joined together by a convexly curved secondary edge (18*a*, 21*a*, 23*a*) which has a radius of curvature r and wherein $3 \leqq R/r$ and preferably $10 \leqq R/r$ applies to radii of curvature R of the main edges relative to the radius of curvature r of the secondary edge.

18. A fan-type grinding wheel according to claim 1, wherein the three main edges are joined together by convexly curved secondary edges (18*a*, 21*a*, 23*a*) having radii of curvature r and $3 \leqq R/r$ and preferably $10 \leqq R/r$ applies to the radii of curvature R of the main edges relative to the radii of curvature r of the secondary edge.

* * * * *